US010337199B2

(12) United States Patent
Lin et al.

(10) Patent No.: US 10,337,199 B2
(45) Date of Patent: Jul. 2, 2019

(54) DRAIN FOR A POOL

(71) Applicant: Intex Marketing Ltd., Tortola (VG)

(72) Inventors: Hua Hsiang Lin, Fujian (CN); Yaw Yuan Hsu, Fujian (CN)

(73) Assignee: Intex Marketing Ltd., Tortola (VG)

( * ) Notice: Subject to any disclaimer, the term of this patent is extended or adjusted under 35 U.S.C. 154(b) by 5 days.

(21) Appl. No.: 15/423,760

(22) Filed: Feb. 3, 2017

(65) Prior Publication Data

US 2017/0198488 A1 Jul. 13, 2017

Related U.S. Application Data

(63) Continuation of application No. 14/550,049, filed on Nov. 21, 2014, now Pat. No. 9,567,762.

(30) Foreign Application Priority Data

Nov. 21, 2013 (CN) ..... 2013 2 0745905 U

(51) Int. Cl.
*E04H 4/12* (2006.01)
*E04H 4/00* (2006.01)

(52) U.S. Cl.
CPC ..... *E04H 4/1236* (2013.01); *E04H 4/0025* (2013.01)

(58) Field of Classification Search
CPC ..... A47K 3/06
USPC ..... 4/506, 507
See application file for complete search history.

(56) References Cited

U.S. PATENT DOCUMENTS 755,747 A 3/1904 Coile
2,838,768 A 6/1958 Fischett
3,225,362 A * 12/1965 Barrera ..... E04H 4/0018 220/4.16
3,409,917 A 11/1968 Howard
3,681,789 A 8/1972 Bott
4,383,564 A * 5/1983 Hoie ..... B65D 88/1656 220/666
4,535,490 A 8/1985 Wright
5,025,515 A 6/1991 Rhines
5,179,740 A 1/1993 Marsilio
D434,826 S 12/2000 Hsu
6,192,528 B1 2/2001 Martinez
6,978,494 B2 * 12/2005 Wu ..... E04H 4/0025 285/201
8,251,302 B2 8/2012 Sloan
8,689,837 B1 4/2014 Smith
(Continued)

FOREIGN PATENT DOCUMENTS

CN 202990479 6/2013
CN 203122975 8/2013
CN 203296409 11/2013

OTHER PUBLICATIONS

Prosecution History of U.S. Pat. No. 9,567,762, issued Feb. 14, 2017; 326 pgs.

(Continued)

*Primary Examiner* — Lauren A Crane

(74) *Attorney, Agent, or Firm* — Faegre Baker Daniels LLP

(57) ABSTRACT

An inflatable pool is includes a floor drain having a drainage conduit and two sealing plug. The drainage conduit includes a midsection pipe having an oblong cross section, an inlet cap having a truncated profile, and an outlet cap that transitions from the oblong profile of the midsection to a cylindrical profile.

29 Claims, 8 Drawing Sheets

(56) References Cited

U.S. PATENT DOCUMENTS

| | | | |
|---|---|---|---|
| 9,567,762 | B2 | 2/2017 | Lin |
| 2006/0096019 | A1 | 5/2006 | Ball |
| 2009/0172874 | A1 | 7/2009 | Johndro |
| 2009/0277974 | A1 | 11/2009 | Citrawireja |
| 2012/0068452 | A1 | 3/2012 | Boettner |
| 2015/0135424 | A1 | 5/2015 | Lin et al. |

OTHER PUBLICATIONS

Declaration of Standley Howell; 8 pgs; available at least as early as Jun. 2, 2017.
Excerpt from *Meriam-Webster's Collegiate Dictionary*, Merriam-Webster, Incorporated (11$^{th}$ ed. 2007); 4 pgs; Nov. 30, 2007.
Rosata, Dominick V.; Rosata, Donald V.; and Rosata, Handbook, 3*rd* ed. (Boston: Kluwer Academic); 362 Marlene G., 2001 Injection Molding pgs; copyright 2001.
Declaration of Samir Nayfeh; 116 pgs; Jun. 2, 2017.
Assignment from Inventors to Recreation Corp., dated Aug. 24, 2015; 4 pgs.
Assignment from Intex Recreation Corp. To Intex Marking Ltd., dated Apr. 20, 2016; 13 pgs.
Corrected Assignment from Intex Industries Xiamen Co., Ltd. And Inventors to Intex Recreation Corp., dated Dec. 21, 2016; 11 pgs.
Petition for Post Grant Review of U.S. Pat. No. 9,567,762, before the Patent Trial and Appeal Board, *Bestway* (*USA*), *Inc.* v. *Intex Marketing Ltd.*, Case No. PGR2017-00029; Jun. 2, 2017; 97 pgs.
Patent Owner's Preliminary Response, before the Patent Trial and Appeal Board, *Bestway* (*USA*), *Inc.* v. *Intex Marketing Ltd.*, Case No. PGR2017-00029; Sep. 8, 2017; 75 pgs.
Decision on Institution of Post-Grant Review 37 C.F.R. § 42.208, before the Patent Trial and Appeal Board, *Bestway* (*USA*), *Inc.* v. *Intex Marketing Ltd.*, Case No. PGR2017-00029; Dec. 4, 2017; 42 pgs.

* cited by examiner

DRAIN FOR A POOL

CROSS REFERENCE TO RELATED APPLICATIONS

This application is a continuation of U.S. application Ser. No. 14/550,049, filed Nov. 21, 2014, and claims priority under 35 U.S.C. §119 to Chinese Patent Application No. 201320745905.2, filed Nov. 21, 2013 and entitled "A Drain Mechanism of an Inflatable Pool", the entire disclosures of which are hereby incorporated by reference herein.

BACKGROUND

Technical Field

The present disclosure relates to an inflatable pool and, in particular, to an inflatable pool having a drain.

Description of the Related Art

Some existing inflatable pools are not provided with a drainage port. As such, a user must turn over the inflatable pool to remove the water, which is inconvenient. In other cases, although the inflatable pool is provided with a drainage port and sealing plug to close the drainage port, the drained water drain on the floor when the inflatable pool drains. This makes it inconvenient to keep the floor clean.

SUMMARY

According to the present disclosure, an inflatable pool is provided that comprises a first internal wall, a second external wall positioned outside of the first internal wall, a floor that cooperates with the internal wall to define a water cavity; and a floor drain in communication with the water cavity. The floor drain includes a drainage conduit having an inlet end positioned interior of the first internal wall and an outlet end positioned external of the first internal wall, a first sealing plug removably coupled to the inlet end to block drainage of water from the water cavity when coupled to the inlet end and permit drainage of water from the water cavity when removed from the inlet end, and a second plug removably coupled to the outlet end of the drainage conduit.

According to another aspect of the present disclosure, an inflatable pool is provided that comprises a first internal wall; a second external wall positioned outside of the first internal wall; a floor that cooperates with the internal wall to define a water cavity; and a floor drain in communication with the water cavity. The floor drain includes a drainage conduit having an inlet end positioned interior of the first internal wall, an outlet end positioned external of the first internal wall, and a midsection pipe. The midsection pipe has an oblong profile having a major axis and a minor axis. The major axis extends in a direction substantially parallel to the floor of the inflatable pool and the minor axis extending in a direction substantially perpendicular to the floor of the inflatable pool According to another aspect of the present disclosure, an inflatable pool is provided that comprising a first internal wall; a second external wall positioned outside of the first internal wall; a floor that cooperates with the internal wall to define a water cavity; and a floor drain in communication with the water cavity. The floor drain includes a drainage conduit having an inlet end and an outlet end, an inlet cap positioned over the inlet end, an outlet cap positioned over the outlet end, and a plug. The inlet cap has a truncated cone-shaped body portion having a substantially circular base and a plug-receiving portion having an opening sized to receive the plug to block the passage of water from the water cavity through the drainage conduit. The truncated cone-shaped body portion expands outwardly from the plug-receiving portion to the substantially circular base.

BRIEF DESCRIPTION OF THE DRAWINGS

The above-mentioned and other features of this disclosure, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates an exemplary embodiment of the present invention, and such exemplification is not to be construed as limiting the scope of the invention in any manner.

DETAILED DESCRIPTION

Figure 1:
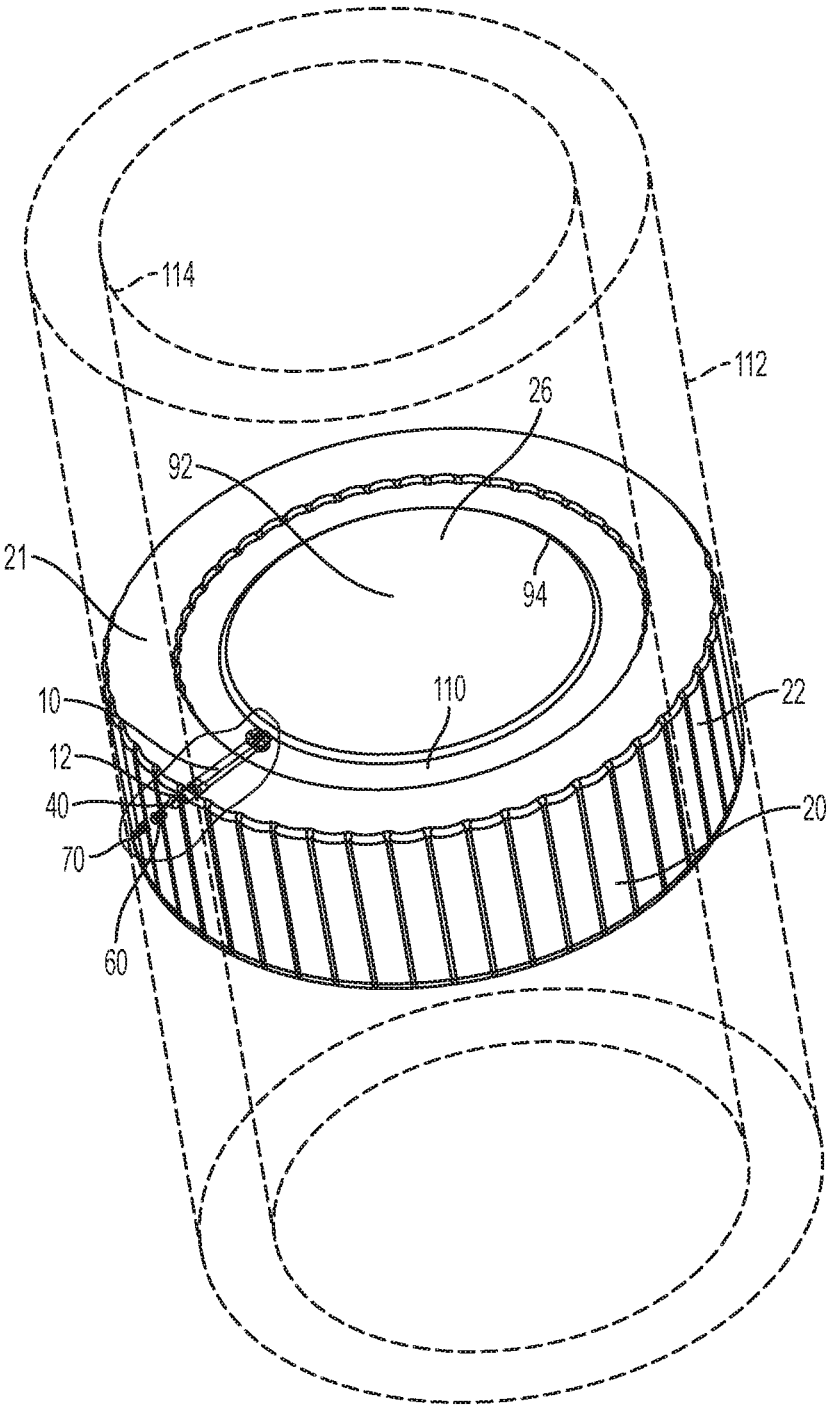
FIG. 1 is a perspective view of an underside of inflatable pool showing the pool having a floor drain.
Figure 2:
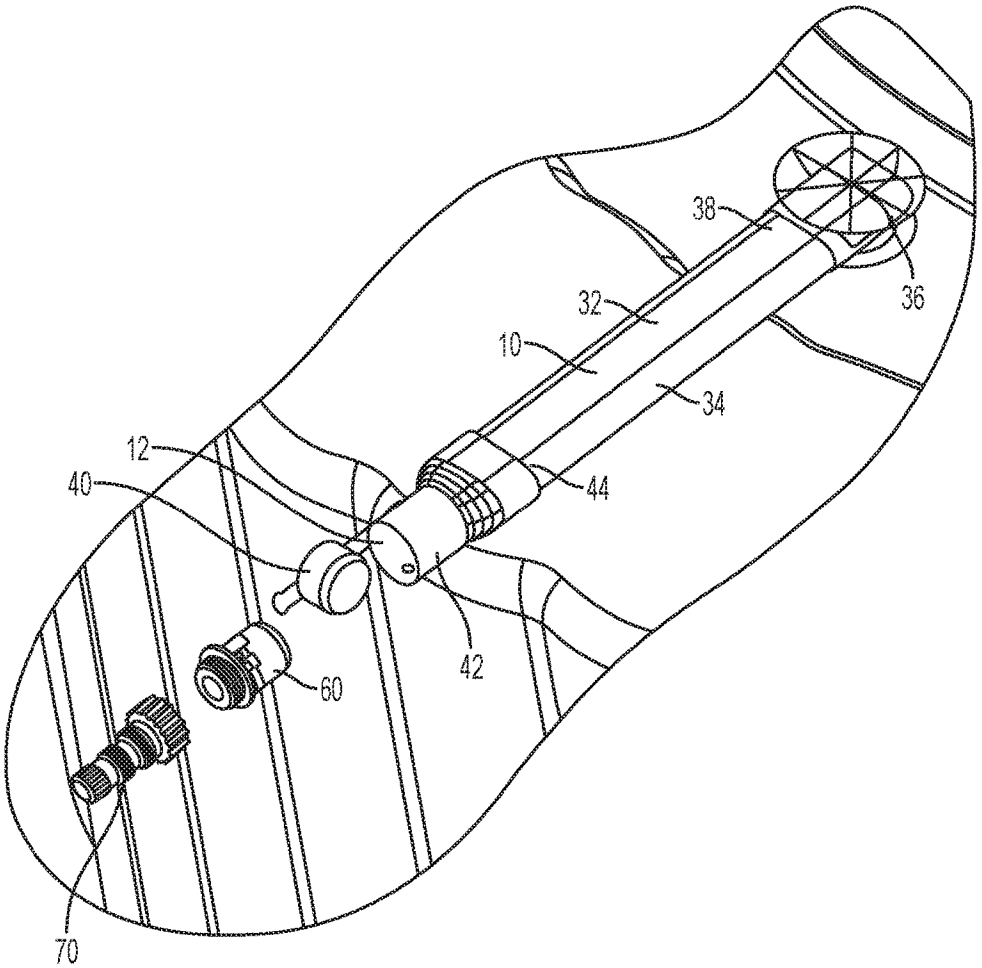
FIG. 2 is an enlarged view of a portion of FIG. 1 showing the floor drain including a drainage conduit including a midsection pipe, an inlet cap coupled to the midsection pipe, and an outlet cap coupled to the midsection pipe, and a plug positioned to plug the outlet cap.
Figure 3:
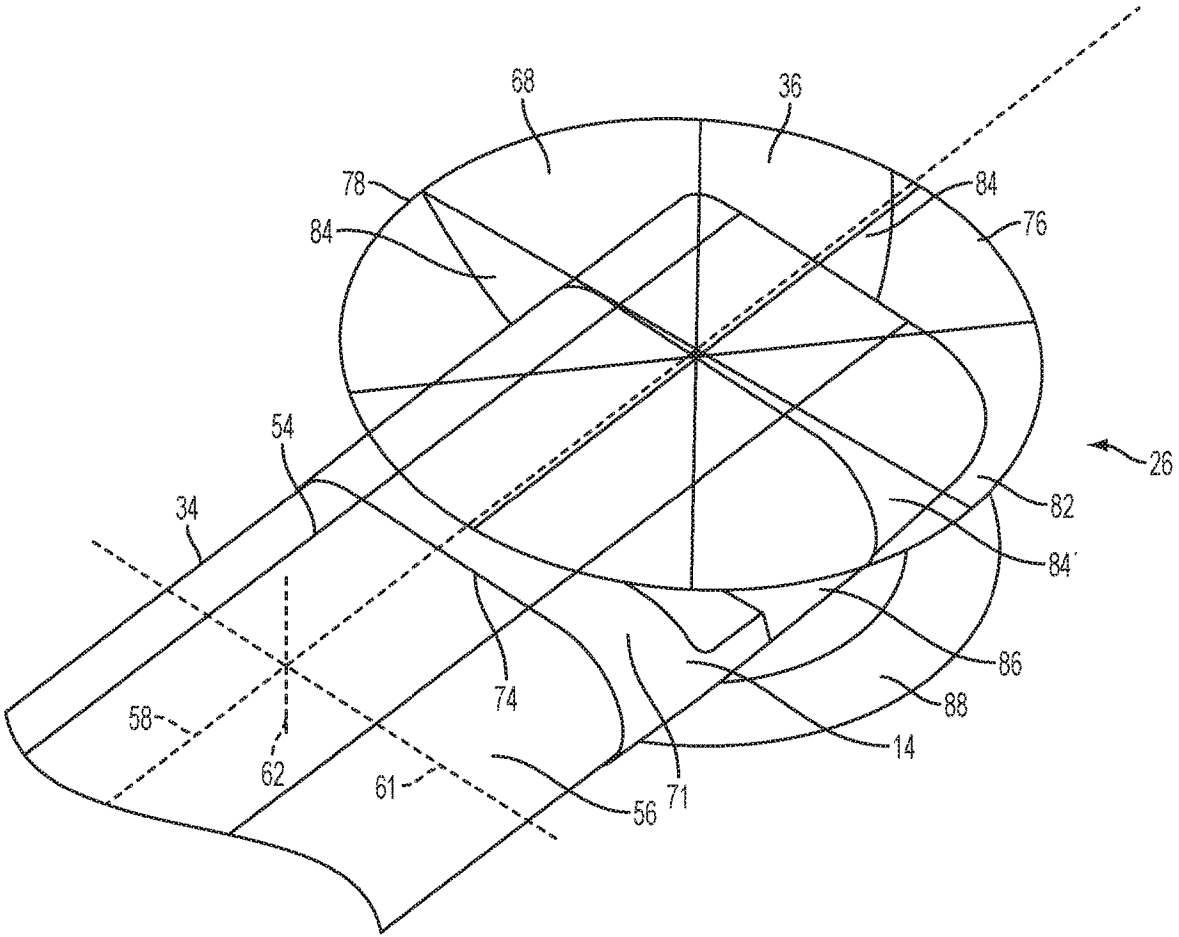
FIG. 3 is a further enlarged view of a portion of FIG. 1 showing the inlet cap transitioning from an oblong profile of the midsection pipe to a truncated conical profile.
Figure 4:
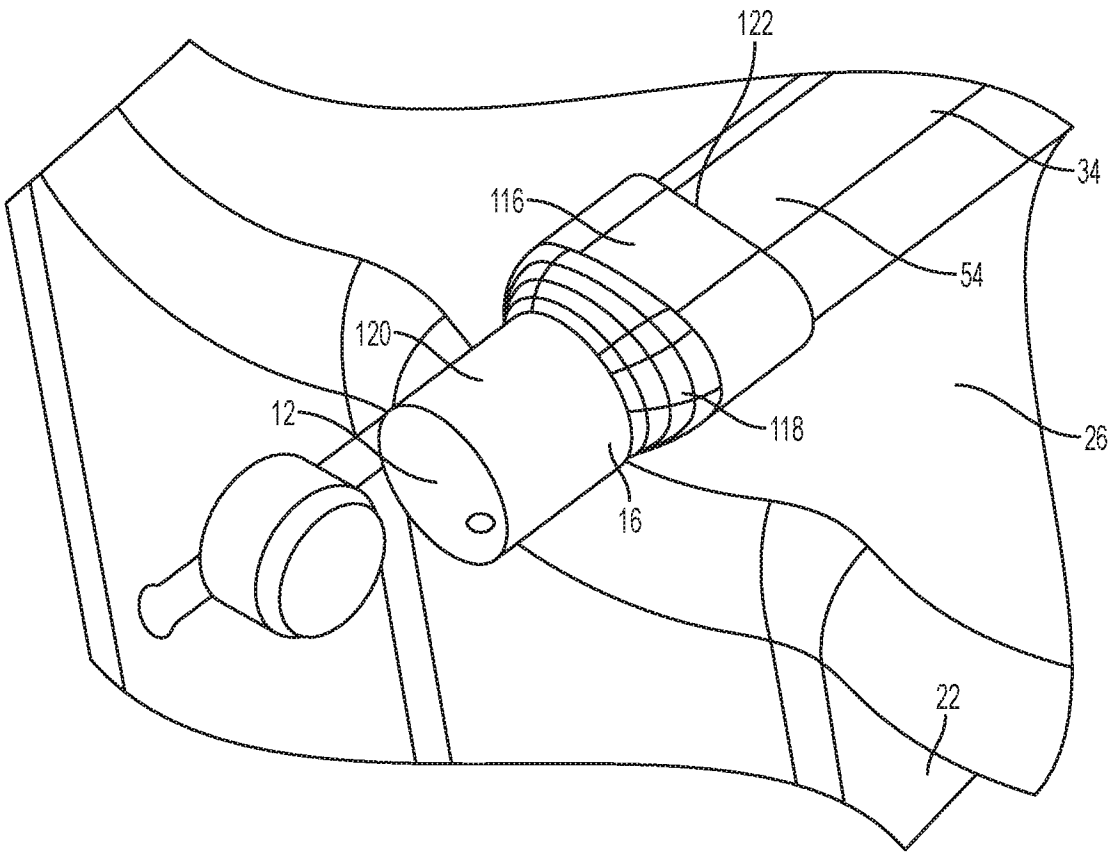
FIG. 4 is a further enlarged view of a portion of FIG. 1 showing the outlet cap transitioning from the oblong profile of the midsection pipe to a cylindrical profile.
Figure 5:
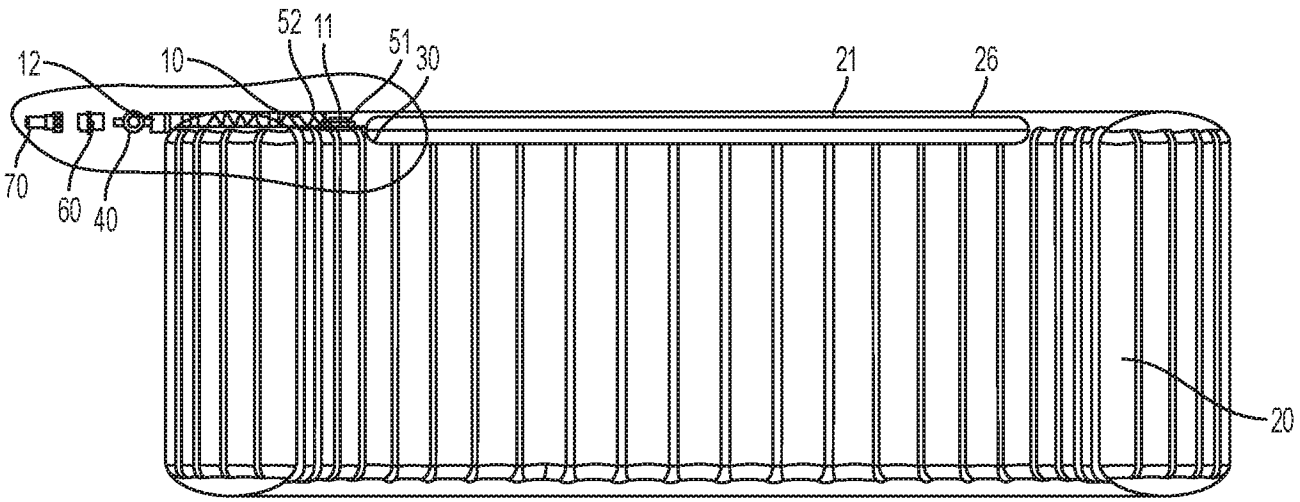
FIG. 5 is a side elevation view of the inflatable pool of FIG. 1 in an upside down orientation.
Figure 6:
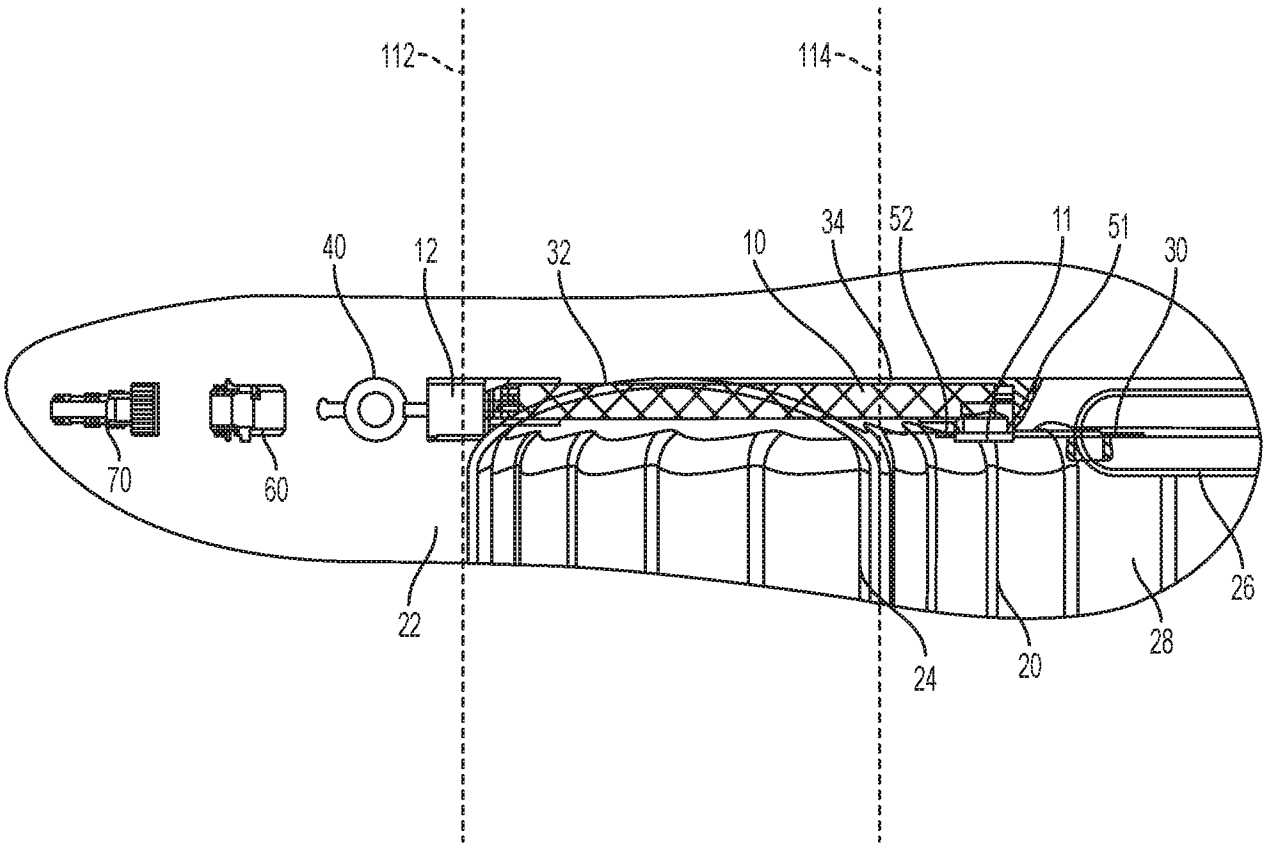
FIG. 6 is an enlarged view of a portion of FIG. 5 showing the floor drain extending from an interior of the inflatable pool to an exterior of the inflatable pool.
Figure 7:
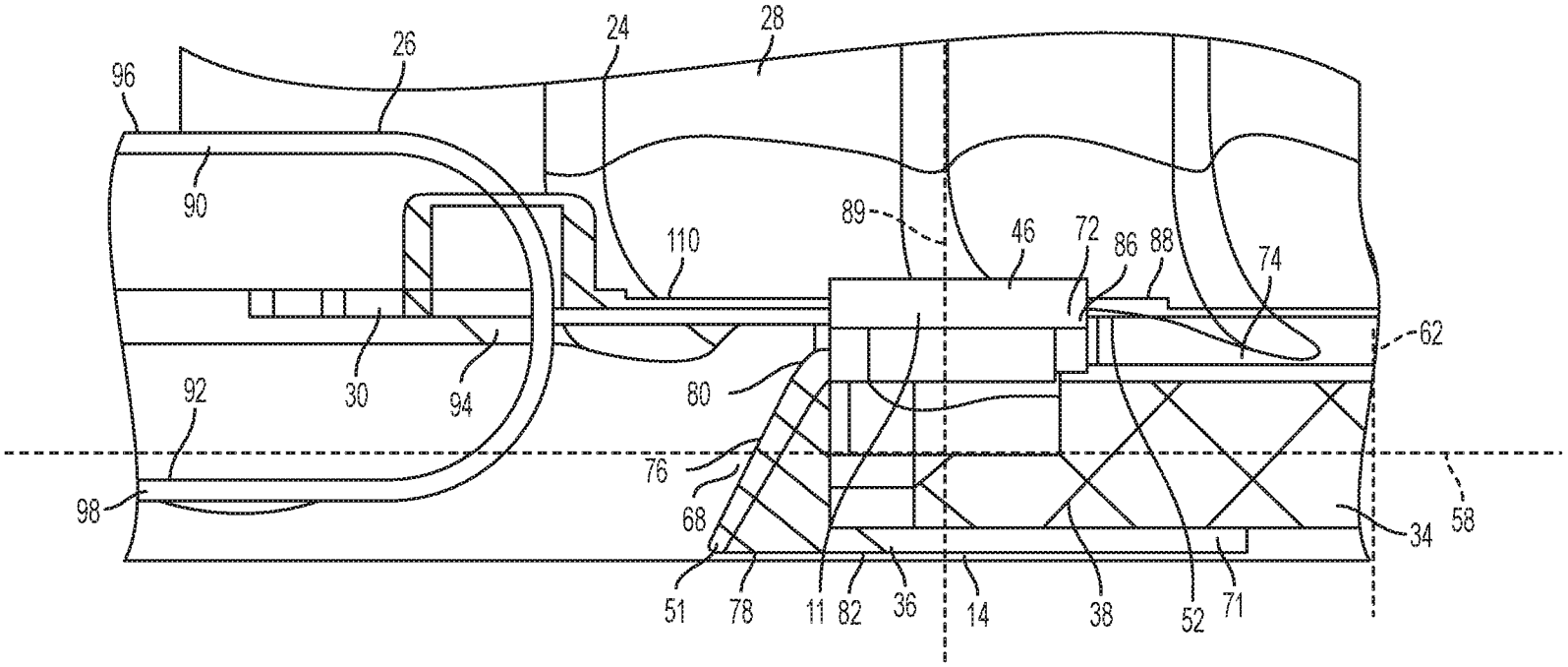
FIG. 7 is a further enlarged view of a portion of FIG. 5 showing the truncated conical profile of the inlet cap.
Figure 8:
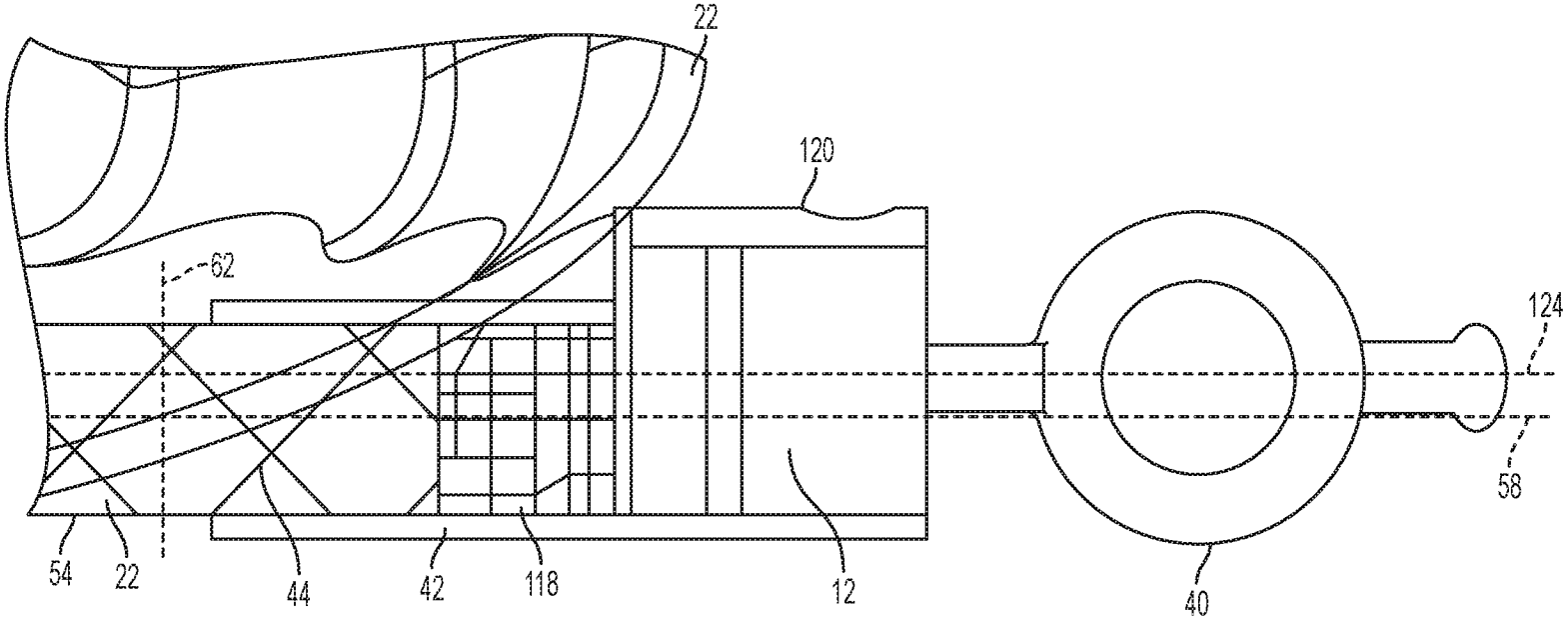
FIG. 8 is a further enlarged view of a portion of FIG. 5 showing the cylindrical profile of the outlet cap offset from the oblong profile of the outlet cap.

As shown in FIG. 1, an inflatable pool 20 is provided (shown in an upside down orientation) that includes scalloped external wall 22, and internal wall 24 (see FIG. 6) positioned inside of external wall 22, and a floor 26. Floor 26 and internal wall 24 cooperate to define a water cavity 28 which holds water during use of inflatable pool 20. Pool 20 includes a floor drain 10 in communication with water cavity 28 to assist in draining pool 20. Floor drain 10 includes drainage conduit 32 having an inlet 11 in an inlet end 14 thereof and an outlet 12 in an outlet end 16 thereof. Drainage conduit 32 is assembled to the bottom of inflatable pool 20. Inlet end 14 containing inlet 11 is connected to floor 26 and positioned inside of internal wall 24. Outlet end 16 of drainage conduit 32 that defines outlet 12 is connected to the exterior of inflatable pool 20 and positioned outside of internal wall 24.

Floor drain 10 further includes a first sealing plug 30 removably coupled to inlet end 14 and a second sealing plug 40 removably coupled to outlet end 16 to block or close respectively inlet 11 and outlet 12 of drainage conduit 32. When inflatable pool 20 is in use, plugs 30, 40 are positioned in inlet 11 and outlet 12 to make water cavity 28 watertight when inflatable pool 20 is filled with water. To drain inflatable pool 20, a user may connect a pipe, such as a garden hose, to outlet 12 of drainage conduit 32 after removing second sealing plug 40. Next, first sealing plug 30 is removed from inlet 11 to permit drainage of the water in water cavity 28 of inflatable pool 20 to another place away from inflatable pool 20, which will assist in keeping the floor supporting inflatable pool 20 clean.

According to the preferred embodiment, drainage conduit 32 is mounted in the external bottom surface of inflatable pool 20. The top surface of drainage conduit 32 is positioned along an external bottom surface of inflatable pool 20.

Floor drain 10 further includes midsection pipe 34, an inlet cap 36 positioned over an inlet end 38 of midsection pipe 34, and an outlet cap 42 positioned over an outlet end 44 of midsection pipe 34. Inlet cap 36 defines inlet 11 of drainage conduit 32 and outlet cap 42 defines outlet 12 of drainage conduit 32. Inlet cap 36 of drainage conduit 32 includes a plug-receiving socket 46 with a hollow hard portion 51 defining inlet 11 and a soft portion 52 fixedly connected to hard portion 51. Soft portion 52 is fixedly connected to floor 26 of inflatable pool 20. When inserted into plug-receiving socket 46, first sealing plug 30 is closely connected to hard portion 51. Soft portion 52 and hard portion 51 are fixedly connected by injection over molding of soft portion 52 over hard portion 51.

Floor drain 10 further includes universal joints 60, 70 that detachably connected to outlet 12. Pipes (not shown), such as garden hoses, may connect to universal joints 60, 70, so that floor drain 10 may connect to pipes with different threaded or other fitting standards.

According to the preferred embodiment of the present disclosure, midsection pipe 34 has an oblong cross section/profile with flat portions 54 and rounded portions 56. Midsection pipe 34 has a longitudinal axis 58. The oblong cross section has a major axis 61 extending through rounded portions 56 in a direction substantially parallel to floor 26 and a minor axis 62 extending through flat portions 54 in a direction substantially perpendicular to floor 26. Flat portions 54 and rounded portions 56 extend in the direction of longitudinal axis 58 between inlet cap 36 and outlet cap 42. Flat portions 54 are substantially parallel to floor 26 of inflatable pool 20.

Inlet cap 36 includes a conical body portion 68, a pipe-receiving portion 71, and an inlet portion 72 that defines inlet 11. Pipe-receiving portion 71 includes an oblong opening 74 sized to receive inlet end 64 of midsection pipe 34. Conical body portion 68 is shaped as a substantially hollow truncated cone 76 having a wide end 78 and a narrow near end 80. Inlet cap 36 includes an oblong profile at pipe-receiving portion 71 that transitions into the truncated conical profile of conical body portion 68 that transitions to the cylindrical profile of inlet portion 72.

Wide end 78 of truncated cone 76 forms a substantially circular base 82 and includes a plurality of ribs 84 that extend radially inwardly from substantially circular base 82. Ribs 84 include a plurality of pair of ribs 84' that extend perpendicular to longitudinal axis 58 in addition to extending radially inward from circular base 82.

Inlet portion 72 of inlet cap 36 includes hard portion 51 and soft portion 52. Additionally, inlet portion 72 includes a neck 86 having the cylindrical profile discussed above and a disk-shaped rim 88 made of soft portion 52 that is fixedly connected to floor 26. Disk-shaped rim 88 is concentric with conical body portion 68 with neck 86 positioned between disk-shaped rim 88 and conical body portion 68. The cylindrical profile of neck 86 has a central axis 89 that is substantially parallel to internal wall 24. The oblong profile of pipe-receiving portion 71 of inlet cap 36 has a major axis 61 and a minor axis 62. Minor axis 62 is substantially parallel to central axis 89 and the major axis 61 is substantially perpendicular to the central axis 89.

Floor 26 includes an upper layer 90 and lower layer 92. Perimeters 94 of upper and lower layers 90, 92 are joined and inner portions 96, 98 are spaced apart. Floor further includes a perimeter layer 110 that extends from internal wall 24 to perimeters 94 of the upper and lower layers 90, 92. Disk-shaped rim 88 of inlet cap 36 is positioned between an adjacent portion of internal wall 24 and adjacent portions of perimeters 94 of upper and lower layers 90, 92.

External wall 22 defines a substantially cylindrical projection 112 and internal wall 24 defines a substantially circular projection 114 that is concentric with and positioned inside substantially cylindrical projection 112. Inlet cap 36 is positioned entirely within cylindrical projections 112, 114. Outlet cap 42 is positioned entirely outside of cylindrical projection 114. Cylindrical projection 112 of external wall 22 extends through outlet cap 42 so that at least a portion of outlet cap 42 is positioned outside of cylindrical projection 112 and at least a portion of outlet cap is positioned inside of cylindrical projection 112.

Outlet cap 42 includes an oblong-shaped body portion 116, a transition portion 118, and a joint-receiving portion 120 that defines outlet 12. Body portion 116 includes an oblong opening 122 sized to receive outlet end 66 of midsection pipe 34 so that body portion 116 has an oblong cross section. Joint-receiving portion 120 has a cylindrical cross section/profile to receive joint 60. Transition portion 118 transitions from the oblong cross section/profile of body portion 116 covering midsection pipe 34 to cylindrical cross section/profile of joint-receiving portion 120. Joint-receiving portion 120 has a central axis longitudinal axis 124. Joint-receiving portion 120 is vertically offset from midsection pipe 34 so that central longitudinal axis 58 of midsection pipe 34 is vertically positioned between central longitudinal axis 124 of the cylindrical profile of joint-receiving portion 120 and a bottom of inflatable pool 20.

While this disclosure has been described as having exemplary designs, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed:

1. A pool comprising:

at least one wall;

a floor that cooperates with the at least one wall to define a water cavity; and a floor drain in communication with the water cavity, the floor drain including a drainage conduit having:

an inlet end including a hard socket and a soft rim, the soft rim being fixedly connected to the hard socket and fixedly connected to the floor of the pool;

a first sealing plug removably received in the hard socket of the inlet end;

an outlet end; and a midsection pipe between the inlet and outlet ends.

2. The pool of claim 1, wherein:

the outlet end of the drainage conduit has a cylindrical profile with a central axis, the central axis of the outlet end being substantially perpendicular to the at least one wall of the pool; and the midsection pipe of the drainage conduit has a length, a width measured in a direction substantially parallel to the floor of the pool, and a height measured in a direction substantially perpendicular to the floor of the pool, the width of the midsection pipe exceeding the height of the midsection pipe, and the midsection pipe having a central axis that extends along the length of the midsection pipe, the central axis of the midsection pipe being vertically positioned between the central axis of the cylindrical profile of the outlet end and a bottom-most surface of the pool.

3. The pool of claim 2, wherein the width of the midsection pipe is measured between two rounded side portions of the midsection pipe.

4. The pool of claim 2, wherein the height of the midsection pipe is measured between a top surface and a flat bottom surface of the midsection pipe.

5. The pool of claim 2, wherein the midsection pipe has an oblong profile with a major axis and a minor axis, wherein the width of the midsection pipe is measured along the major axis of the midsection pipe and the height of the midsection pipe is measured along the minor axis of the midsection pipe.

6. The pool of claim 2, wherein the inlet end of the drainage conduit has a cylindrical profile with a central axis, the central axis of the inlet end being substantially parallel to the at least one wall of the pool.

7. The pool of claim 2, wherein the outlet end of the drainage conduit is configured to connect with a threaded hose.

8. The pool of claim 7, further comprising a second cap removably coupled to the outlet end of the drainage conduit, wherein the outlet end of the drainage conduit is configured to connect with the threaded hose when the second cap is removed from the outlet end of the drainage conduit.

9. The pool of claim 2, further comprising a universal joint configured to couple the floor drain to a pipe.

10. The pool of claim 9, wherein the pipe is a hose.

11. The pool of claim 2, wherein:

the inlet end of the drainage conduit is positioned horizontally inward of the at least one wall of the pool;

the outlet end of the drainage conduit is positioned horizontally outward of the at least one wall of the pool; and the midsection pipe of the drainage conduit extends beneath the floor of the pool and beneath the at least one wall of the pool.

12. The pool of claim 11, wherein the outlet end of the drainage conduit is positioned horizontally outward of the at least one wall of the pool.

13. The pool of claim 2, wherein the pool is inflatable and the at least one wall includes a first internal wall and a second external wall positioned outside of the first internal wall.

14. The pool of claim 1, wherein:

the inlet end of the drainage conduit has a central axis that is substantially parallel to the at least one wall of the pool;

the outlet end of the drainage conduit has a central axis that is substantially perpendicular to the at least one wall of the pool; and the midsection pipe of the drainage conduit has a central longitudinal axis that is vertically positioned below the central axis of the outlet end and above a bottom-most surface of the pool.

15. The pool of claim 14, wherein the midsection pipe has a top surface that extends beneath the floor of the pool and a flat bottom surface that extends along the ground.

16. The pool of claim 15, wherein the midsection pipe includes rounded side portions that extend between the top and bottom surfaces.

17. The pool of claim 15, wherein the top surface of the midsection pipe is flat.

18. The pool of claim 14, wherein the outlet end of the drainage conduit is configured to connect with a threaded hose.

19. The pool of claim 18, further comprising a second cap removably coupled to the outlet end of the drainage conduit, wherein the outlet end of the drainage conduit is configured to connect with the threaded hose when the second cap is removed from the outlet end of the drainage conduit.

20. The pool of claim 14, further comprising a universal joint configured to couple the floor drain to a pipe.

21. The pool of claim 14, wherein the pool is inflatable and the at least one wall includes a first internal wall and a second external wall positioned outside of the first internal wall.

22. The pool of claim 1, wherein the floor of the pool includes:

an upper layer having a perimeter; and a lower layer having a perimeter coupled to the perimeter of the upper layer.

23. The pool of claim 22, wherein the soft rim of the drainage conduit is positioned horizontally inward of the at least one wall of the pool and horizontally outward of the perimeters of the upper and lower layers of the floor of the pool.

24. The pool of claim 1, wherein the soft rim is overmolded onto the hard socket.

25. The pool of claim 1, wherein the inlet end of the drainage conduit further includes a plurality of radially extending ribs.

26. The pool of claim 1, wherein the outlet end of the drainage conduit is configured to connect with a threaded hose.

27. The pool of claim 26, further comprising a second cap removably coupled to the outlet end of the drainage conduit, wherein the outlet end of the drainage conduit is configured to connect with the threaded hose when the second cap is removed from the outlet end of the drainage conduit.

28. The pool of claim 1, further comprising a universal joint configured to couple the floor drain to a pipe.

29. The pool of claim 1, wherein the pool is inflatable and the at least one wall includes a first internal wall and a second external wall positioned outside of the first internal wall.

* * * * *